United States Patent [19]

Chard et al.

[11] Patent Number: 4,696,311

[45] Date of Patent: Sep. 29, 1987

[54] FORMING A ROD OF SMOKABLE MATERIAL

[75] Inventors: Brian C. Chard, Bristol; John D. Hooper; Christopher R. Bale, both of Keynsham, all of England

[73] Assignee: Imperial Group Public Limited Company, England

[21] Appl. No.: 810,502

[22] Filed: Dec. 19, 1985

[30] Foreign Application Priority Data

Dec. 21, 1984 [GB] United Kingdom ..... 8432410

[51] Int. Cl.[4] ..... A24C 5/18

[52] U.S. Cl. ..... 131/109.1; 131/108; 131/109.2; 131/110; 131/84.1; 131/84.3; 131/909

[58] Field of Search ..... 131/84.1, 84.3, 909, 131/108, 109.1, 109.2, 110, 109.7

[56] References Cited

U.S. PATENT DOCUMENTS 4,630,618 12/1986 Chard ..... 131/84.3

*Primary Examiner*—V. Millin

*Attorney, Agent, or Firm*—Larson & Taylor

[57] ABSTRACT

In a machine for making cigarette rods containing two types of tobacco there is provided a dual hopper (1200) for containing the two types of tobacco separately and a conveyor (1206) to transport the tobaccos side by side to a chute (1203) and then to a carding area (1214). The levels of the tobaccos in the carding area are monitored and if one is too high then an appropriate flap (306,308) in the chute is opened and that type of tobacco is diverted and recycled to the hopper (1200) until the level of that tobacco in the carding area has returned to an acceptable level, whereupon said flap is closed and that type of tobacco is able to re-enter the carding area.

7 Claims, 5 Drawing Figures

FORMING A ROD OF SMOKABLE MATERIAL

This invention relates to the manufacture of a rod of smokable material, such as is used in cigarettes, and is concerned with the production of a rod in which the smokable material consists of more than one type of smoking material, in particular a rod in which the types of smoking material are demarcated.

The types of smoking material envisaged in the present invention include those exhibiting different natures or compositions and may, for instance, comprise various types of tobacco, one type for example possessing a low level of nicotine and another type possessing a high level of nicotine, tobacco products such as re-constituted tobacco, or tobacco substitutes. For the purposes of this invention, "tobacco substitute" will be understood to include not only smokable materials such as cellulose derivatives but inert fillers such as alumina.

An apparatus for, and method of, forming a rod of tobacco from two types of tobacco is described U.S. Pat. No. 4,630,618 to Chard. It is known to form a rod of tobacco from two types (A,B) of tobacco in which the two types are stored separately in a partitioned hopper and subsequently deposited on an air pervious conveyor belt so that type B overlies type A. Deposition of type A on the belt is periodically inhibited in favour of type B by means of an air jet directed at the belt.

In order that the present invention will be better understood its background will be described with reference to FIGS. 1 and 2 of the accompanying diagrammatic non-scale drawings in which FIG. 1 is a side view of a portion of a conventional cigarette rod making machine and is identical to FIG. 1 of U.S. Pat. No. 4,630,618 and FIG. 2 is a vertical section through a hopper and carding drum arrangement of a known cigarette making machine.

Referring to FIG. 1 there is shown in outline a portion of a conventional cigarette making machine, such as a Molins "Mark 8" modified according to the invention disclosed and claimed in U.S. Pat. No. 4,630,618. The machine includes a tobacco rod cutting knife and a filter plug assembly mechanism, both of which are well-known and are not illustrated herein.

There is provided a charging hopper 12 adapted to contain separately two different types of tobacco, A and B, by means of a vertical partition 14 dividing the hopper into two compartments.

There is provided an air pervious vacuum conveyor belt 16 running in the direction of arrow 18, vacuum being applied to the top surface of the lower run 20 of the belt by a vacuum source.

Both types of tobacco are conveyed from the hopper 12 to an upwardly directed air entrainment chimney 22 that is directed at the underside of the lower run 20 of the belt, by a conventional carding conveyor shown diagrammatically at 21, 23 leading from the hopper to the base of the chimney.

At the chimney the two types of tobacco A and B are entrained in an air stream and proceed upwardly through the chimney in two parallel streams 24, 26 corresponding to the respective types A and B. The boundary layer between the streams is indicated by chain line 25. The tobacco is held on the underside of the lower run 20 of the belt by virtue of the vacuum applied to the belt from vacuum box 19 and is carried in the direction of arrow 18 to the remainder of the cigarette making machine indicated generally at 28, where it is formed into a rod of tobacco and enclosed in cigarette paper, in a known manner.

It will be seen that when the tobacco ascends the chimney and is laid on the belt, type A from stream 24 is laid first and is then overlaid by type B from stream 26.

A timed gate means, i.e. an airjet, is located adjacent the lower run 20 of the belt at a point 30 where the boundary 25 between the streams 24 and 26 meets the lower run 20. The effect of the gate means is to block periodically the carriage of tobacco type A on the belt and to permit type B to be deposited directly onto the belt.

FIG. 2 shows a hopper and carding drum arrangement of a known cigarette making machine.

There is shown a hopper 200 in which there is contained a quantity of tobacco 202. A flap 204 at the base of the hopper 200 permits tobacco to fall onto an elevator band 206 which moves in the direction of arrows 207. A refuser roll 208 limits the amount of tobacco that reaches the top of the elevator band 206. At the top of the elevator band a magnet 210 is provided to remove unwanted ferrous matter from the tobacco.

The tobacco 201 falls from the top of the elevator band down a chute 203 past a rotating flap cleaner 212 onto a curved plate 214 which forms a nip with a coarse carding drum 216. The carding drum 216 rotates in the direction of arrow 217 so as to oppose the downward motion of the falling tobacco. Some tobacco accumulates in the nip to form a roll 218 and surplus tobacco is carried upwards by the coarse carding drum 216 to a second nip between that drum and a fine carding drum 220. The fine carding drum 220 rotates in the same direction as coarse carding drum 216. A second roll 222 of tobacco is formed in the second nip, and its size may be dictated by a photocell 224 or other level sensing device.

Tobacco passing through the second nip in the direction of arrow 225 is delivered to further parts of the making machine denoted in general by box 226. Dust and shorts from the first nip are taken out of the system by an extractor 228.

The use of a coarse carding drum together with a fine carding drum is believed to smooth changes in elevator feed rates.

If the carding drum arrangement of FIG. 2 is used in conjunction with the partitioned charging hopper 12 of FIG. 1 containing, for example types A and B of tobacco having differing physical characteristics and dissimilar volumetric flows, it may be found that the roll 218—which is to be understood in FIG. 2 as extending axially at right angles to the paper—does not maintain a stable size along its length; and this instability will affect the type A/B tobacco ratio in the final cigarette rod.

It is an object of the present invention to stabilize the roll 218 when used in conjunction with a partitional tobacco supply hopper as described in U.S. Pat. No. 4,630,618.

According to the present invention there is provided an apparatus for controlling the ratio of two fluent materials fed from hopper means containing separate first and second fluent materials to a receiving area, the apparatus comprising, (a) conveyor means arranged to receive the fluent materials from the hopper means so that the fluent materials lie in juxtaposition on the conveyor means, (b) means for controlling the speed of the conveyor means, (c) chute means for transferring the fluent materials in the same relative juxtaposition to the receiving area, (d) means for continuously removing a proportion of the fluent materials from the receiving area thereby leaving a proportion of the fluent materials in the receiving area, (e) first and second controllable interception means for independently intercepting and diverting away from the receiving area respective first and second fluent materials falling down the chute means, (f) first and second monitor means for monitoring the quantities of the first and second fluent materails respectively remaining in the receiving area and generating respective first or second signals dependent on the quantity of the first or second fluent material falling below a first predetermined level in the receiving area, and, (g) first circuit means responsive to the said signals and adapted on receipt of one or said signals that the amount of one said fluent material has fallen below said predetermined level in the receiving area to actuate one of the interception means so as to intercept and divert other said fluent material away from the receiving area and to increase the speed of the conveyor means from a first value so as to increase the rate of supply of one said fluent material to the receiving area, and, on a cessation of said signal indicating that the amount of one said fluent material has risen to said first predetermined level in the receiving area, to de-actuate said one of the interception means so as to restore flow of other said fluent material to the receiving area and to decrease the speed of the conveyor means to its first value.

Fluent material diverted from the receiving area is preferably returned to its respective hopper means by screw conveyor, vibratory conveyor, or band conveyor means.

The receiving area may be a nip between a carding drum and a plate.

The conveyor means may be a continuous elevator adapted to carry loose strands of tobacco or similar material.

The means for continuously removing a proportion of the fluent material from the receiving area is preferably the carding drum.

There may be provided third and fourth monitor means for monitoring the quantities of the first and second fluent materials respectively remaining in the receiving area and generating respective third or fourth signals dependent on the quantity of the first or second fluent material exceeding a second predetermined level in the receiving area, and second circuit means responsive to said third and fourth signals and adapted on receipt of one of said third or fourth signals to actuate the interception means corresponding to the respective first or second fluent material so as to intercept and divert that fluent material away from the receiving area, and, on cessation of said third or fourth signal, to de-actuate said actuated interception means so as to restore flow of said respective first or second fluent material to the receiving area.

The interception means may be provided by hinged flaps.

The invention will now be described by way of example only with reference to FIGS. 3, 4 and 5 of the accompanying diagrammatic drawings, in which, FIG. 3 is an oblique perspective view of the hopper and carding drum arrangement of FIG. 2 but modified according to the invention;

Figure 2:
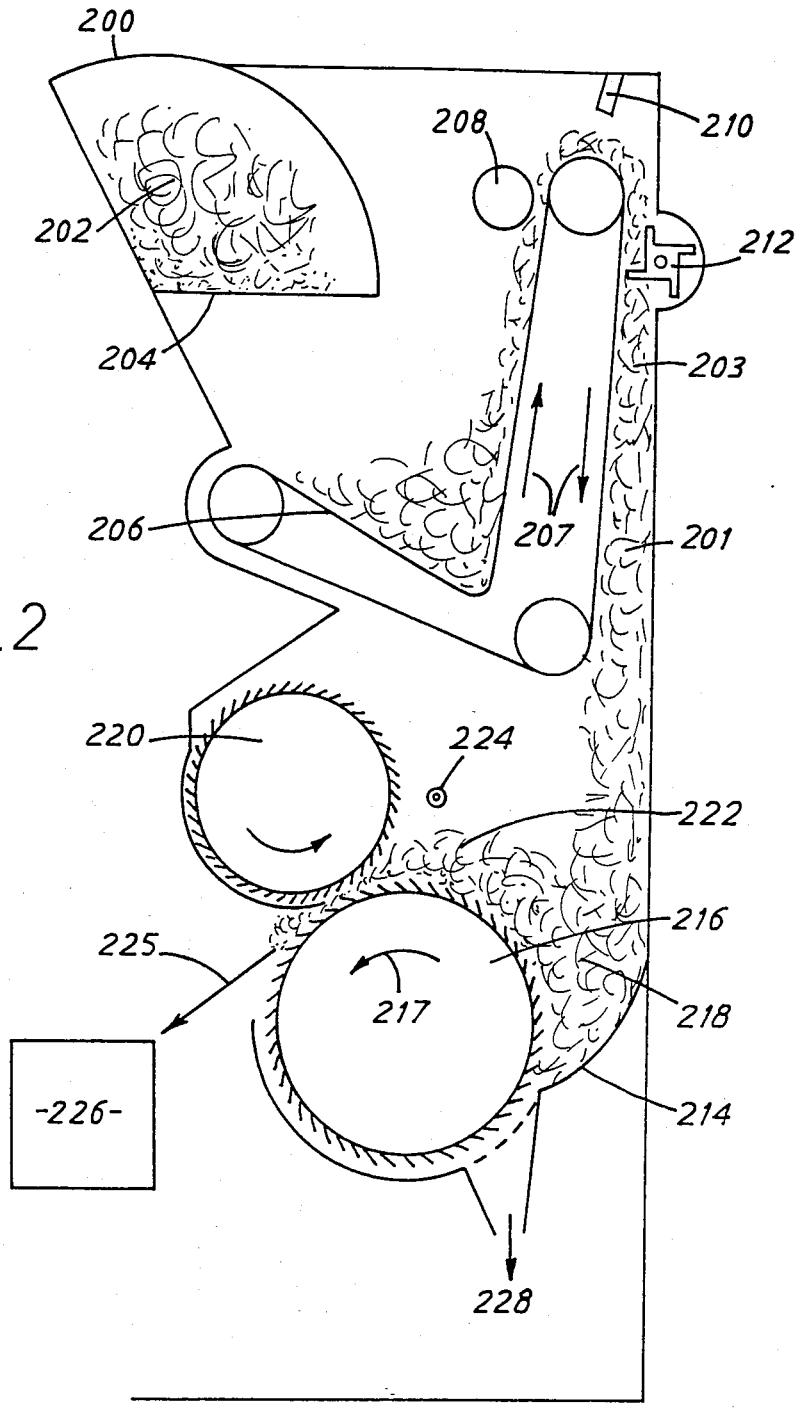
Figure 3:
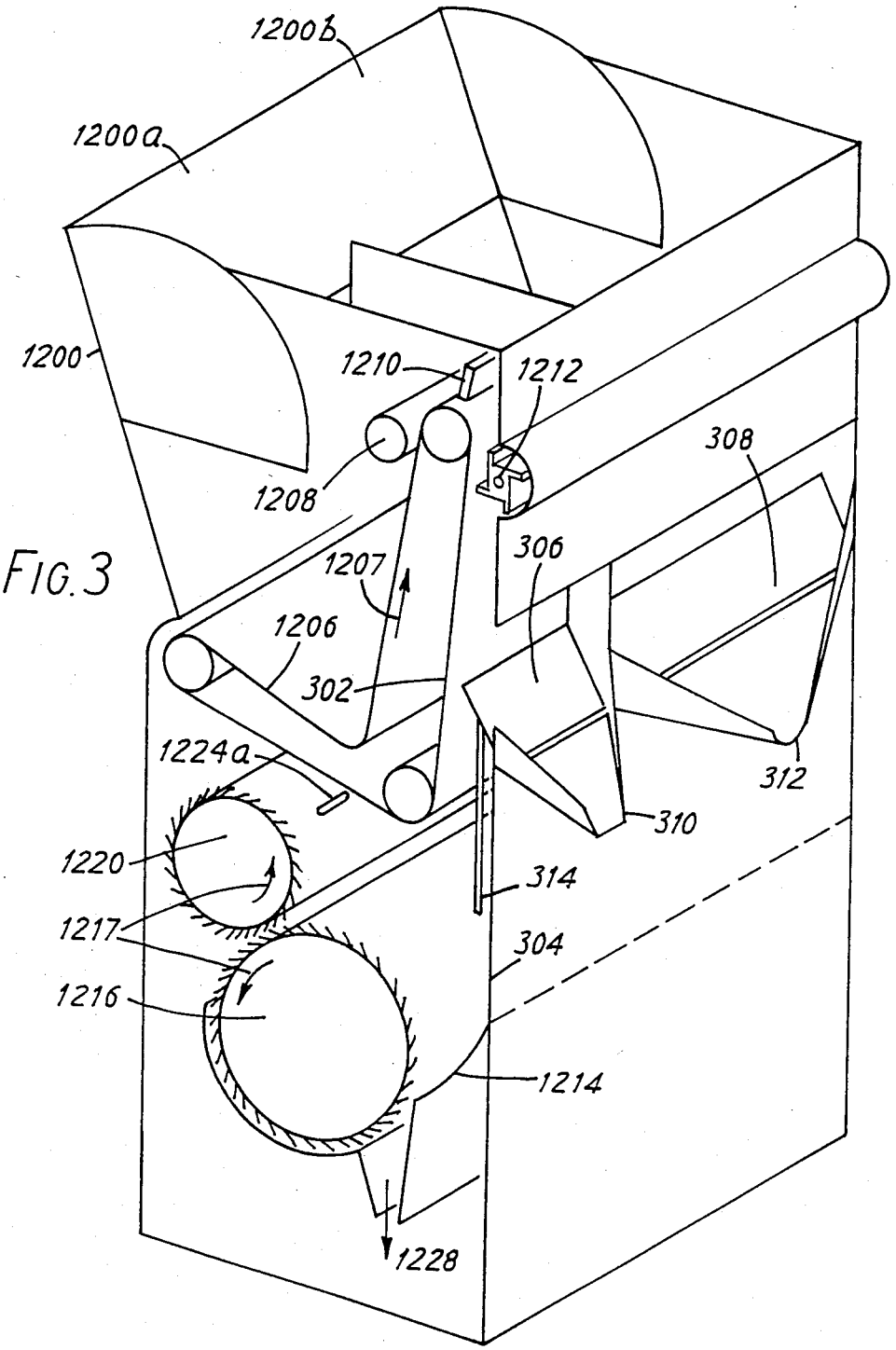
Figure 4:
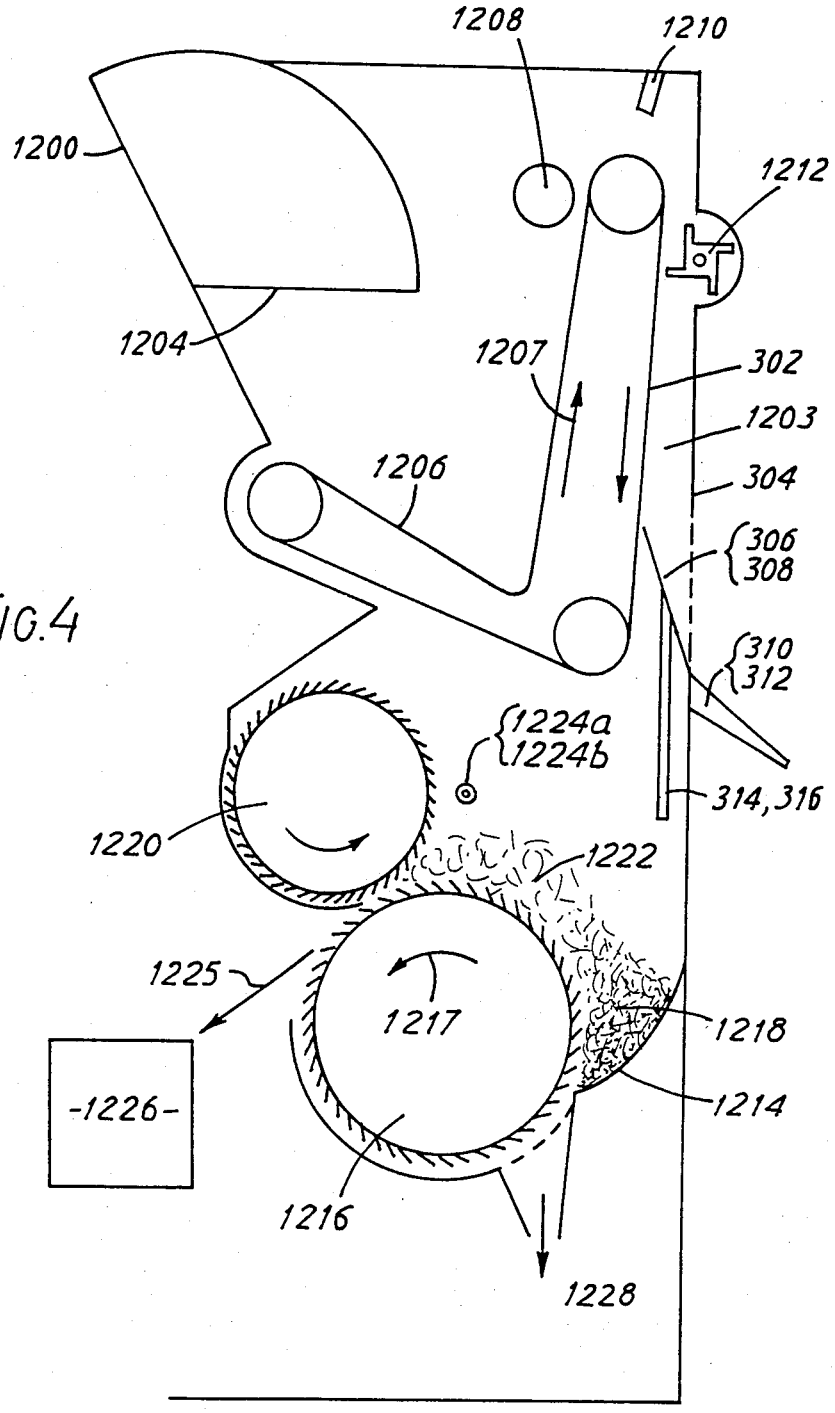
FIG. 4 is a vertical section through the arrangement of FIG. 3.

Generally, there is shown in FIGS. 3 and 4 a carding drum arrangement of a known cigarette making machine in combination with a double tobacco hopper arrangement as disclosed in U.S. Pat. No. 4,630,618. The general arrangement is similar to that shown in FIG. 2 and features identical to those in FIG. 2 will be given the same numbers as in FIG. 2 but prefixed by "1".

In FIGS. 3 and 4 there is shown a double hopper 1200 partitioned into compartments 1200*a* and 1200*b* each containing a different type of tobacco 1202*a* and 1202*b* respectively. A flap 1204 at the base of the hopper 1200 permits tobacco to fall onto an elevator band 1206 which moves in the direction of arrows 1207 so that the two types of tobacco lie side by side in juxtaposition on the elevator band. A refuser roll 1208 limits the amount of tobacco that reaches the top of the elevator band 1206. A magnet 1210 is further provided at the top of the elevator band to remove unwanted ferrous matter from the tobacco.

The tobacco falls from the top of the elevator band down a chute 1203 defined by a downward run 302 of the elevator band and an outer wall 304 of the apparatus past a rotating flap cleaner 1212 onto a curved plate 1214 which forms a nip with coarse carding drum 1216. The coarse carding drum 1216 rotates in the direction of arrow 1217 so as to oppose the downward motion of the falling tobacco.

Some tobacco accumulates in the nip to form a longitudinally extending roll 1218 and surplus tobacco is carried upwards by the coarse carding drum 1216 to a second nip between the coarse carding drum and a fine carding drum 1220 which rotates in the same direction as coarse carding drum 1216. A second longitudinally extending roll 1222 of tobacco is formed in the second nip.

Each roll of tobacco, which may in another embodiment continue to form one roll, is formed of the two types of tobacco as two distinct axial sections of the roll corresponding to the respective contents of the hopper compartments 1200*a* and 1200*b*.

A pair of photocells 1224*a*, 1224*b* (only one of which is shown) is provided, each of which detects the size of that section of the roll corresponding to the respective type of tobacco, and generates a signal indicative of a roll section that is below a predetermined size.

Tobacco passing through the second nip in the direction of arrow 1225 is delivered to further parts of the making machine denoted in general by box 1226.

Dust and shorts from the first nip are taken out of the system by an extractor means 1228.

There is provided in the outer wall 304 a pair of interception means or hinged flaps 306, 308 and, external to the wall 304, a pair of delivery chutes 310, 312 corresponding to the respective flaps 306, 308. Each flap 306, 308 is adapted to turn about a horizontal axis inwards towards the downward run 302 of the elevator and so to divert anything falling down the chute 1203 to one or the other respectively of the delivery chutes 310, 312.

Each flap 306, 308 is operated independently of the other by respective flap control rods 314, 316 (of which only 314 is visible in FIG. 3). The delivery chutes 310, 312 are connected by conveyor means, not shown, to respective hopper compartments 1200*a*, 1200*b*. Consequently, any tobacco diverted by either of the flaps 306, 308 will be returned to one or the other of the hopper compartments 1200*a*, 1200*b*.

Figure 1:
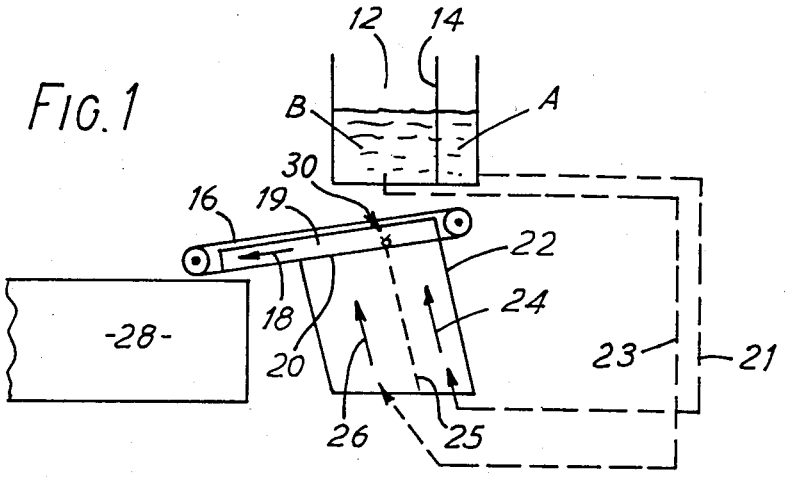
Figure 5:
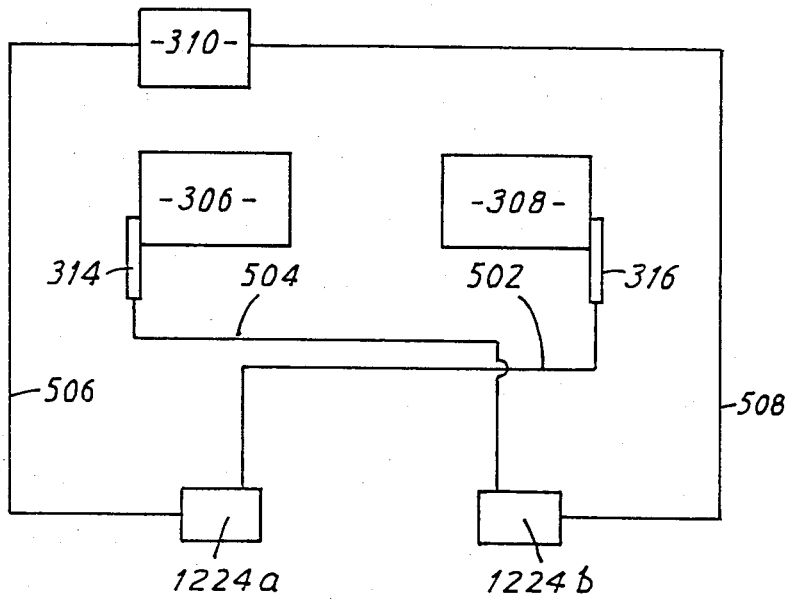
FIG. 5 is control circuitry for use with the hopper and carding drum arrangement of FIGS. 3 and 4.

FIG. 5 shows in outline the control circuitry whereby the flaps 306 and 308 are controlled by signals generated by the photocells 1224*a* and 1224*b*.

Control signals generated by photocell 1224*a* pass along wire 502 to the controlling mechanism (not shown) for flap control rod 316 which controls flap 308.

Similarly, control signals generated by photocell 1224*b* pass along wire 504 to the controlling mechanism (not shown) for flap control rod 314 which controls flap 306.

A further control signal is generated by either photocell when it generates a signal directed to a flap rod control mechanism, and this further control signal passes along either of wires 506 or 508, as appropriate, to a speed control mechanism 310 for the elevator band 1206.

In normal operation of the apparatus the flaps 306, 308 will be closed, that is, they will allow tobacco to fall down the chute 1203 to the carding drums where, as described above, one or more rolls of tobacco are formed. Also, the elevator band will move at a normal speed. In normal operation the one or more rolls of tobacco will remain substantially constant in diameter and surplus tobacco will be passed to the rest of the rod making mechanism, as described in U.S. Pat. No. 4,630,615.

For example, if, for any reason, a section of the roll, corresponding, let us say, to the tobacco type 1202*a* coming from hopper compartment 1200*a* should reduce in diameter, then this event will be detected by photocell 1224*a* which then sends a first control signal to the controlling mechansim for flap rod 316 and the further control signal to the speed control mechanism 310 for the elevator band. Flap rod 316 then acts to open flap 308 and divert tobacco type 1202*b* via delivery chute 312 and conveying means (not shown) back to hopper compartment 1200*b*, while the speed control mechanism 310 is caused by the further control signal to speed up the elevator band.

Hence, there is now an increased delivery of tobacco type 1202*a* to the tobacco roll. When the size of the tobacco roll section formed by tobacco type 1202*a* has reached its predetermined size then photocell 1224*a* will detect this, signal flap 308 to be closed (so that tobacco type 1202*b* is now fed to the roll), and signal the control mechanism 310 to return the elevator band to its normal speed.

A similar set of actions will take place if the section of roll corresponding to tobacco 1202*b* reduces in diameter.

It is envisaged that the increased speed of the elevator band may be about 3.8 times its normal speed, but this will naturally depend on the types of material being handled.

Further control circuitry may be added to that just described to deal with the situation wherein that section of the tobacco roll corresponding to, let us say, tobacco type 1202*a* increases in size to an unacceptable level. Here, it would be arranged for the flap 306 corresponding to that section of the roll to be closed until that section of the roll diminishes to its predetermined size.

The invention thus enables the cigarette manufacturer to make more efficiently the type of cigarette rod that consists of more than one type of tobacco physically distinct in the rod. It is, for example, made easier to make dual rods consisting of expanded and unexpanded tobacco because the great disparity in densities of such tobaccos would normally render it difficult to achieve stability in tobacco roll size in the nip of the carding drum and would thus alter the ratio of the two tobaccos being fed to the rest of the making machine. The present invention enables this stability to be more easily achieved.

In an alternative embodiment, not illustrated, the flaps 306, 308 may be replaced by alternative means for intercepting and diverting tobacco to the chutes 310, 312. Such alternative means may be jets of air directed at the tobacco, or sources of vacuum to draw the tobacco onto the chutes.

In yet another alternative embodiment, the hopper 200 may be replaced by a pneumatic feed system.

We claim:

1. An apparatus for controlling the ratio of two fluent materials fed from hopper means containing separate first and second fluent materials to a receiving area, the apparatus comprising, (a) conveyor means arranged to receive the fluent materials from the hopper means so that the fluent materials lie in juxtaposition on the conveyor means, (b) means for controlling the speed of the conveyor means, (c) chute means for transferring the fluent materials in the same relative juxtaposition to the receiving area, (d) means for continuously removing a proportion of the fluent materials from the receiving area thereby leaving a proportion of the fluent materials in the receiving area, (e) first and second controllable interception means for independently intercepting and diverting away from the receiving area respective first and second fluent materials falling down the chute means, (f) first and second monitor means for monitoring the quantities of the first and second fluent materials respectively remaining in the receiving area and generating respective first or second signals dependent on the quantity of the first or second fluent material falling below a first predetermined level in the receiving area, and, (g) first circuit means responsive to the said signals and adapted on receipt of one or said signals that the amount of one said fluent material has fallen below said predetermined level in the receiving area to actuate one of the interception means so as to intercept and divert other said fluent material away from the receiving area and to increase the speed of the conveyor means from a first value so as to increase the rate of supply of one said fluent material to the receiving area, and, on a cessation of said signal indicating that the amount of one said fluent material has risen to said first predetermined level in the receiving area, to de-actuate said one of the interception means so as to restore flow of other said fluent material to the receiving area and to decrease the speed of the conveyor means to its first value.

2. An apparatus as claimed in claim 1, wherein there are provided third and fourth monitor means for monitoring the quantities of the first and second fluent materials respectively remaining in the receiving area and generating respective third or fourth signals dependent on the quantity of the first or second fluent material exceeding a second predetermined level in the receiving area, and second circuit means responsive to said third and fourth signals and adapted on recept of one of said third or fourth signals to actuate the interception means corresponding to the respective first or second fluent material so as to intercept and divert that fluent material away from the receiving area, and, on cessation of said third or fourth signal, to de-actuate said actuated interception means so as to restore flow of said respective first or second fluent material to the receiving area.

3. An apparatus as claimed in claim 1 wherein the interception means is provided by hinged flaps.

4. An apparatus as claimed in claim 1 wherein there is provided means to return diverted fluent material to its respective hopper.

5. An apparatus as claimed in claim 1 wherein the receiving area is a nip between a carding drum and a plate.

6. An apparatus as claimed in claim 5 wherein the means for continuously removing a proportion of the fluent material from the receiving area is the carding drum.

7. An apparatus as claimed in claim 1 wherein the conveyor means is a continuous elevator adapted to carry loose strands of tobacco or similar material.

* * * * *